US011717136B2

(12) United States Patent
Cariello

(10) Patent No.: US 11,717,136 B2
(45) **Date of Patent: *Aug. 8, 2023**

(54) DEBRIS CAPTURING APPARATUS

(71) Applicant: Donna Cariello, Levittown, NY (US)

(72) Inventor: Donna Cariello, Levittown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/740,895

(22) Filed: May 10, 2022

(65) Prior Publication Data

US 2022/0265120 A1 Aug. 25, 2022

Related U.S. Application Data

(63) Continuation of application No. 17/014,497, filed on Sep. 8, 2020, now Pat. No. 11,324,384, which is a continuation of application No. 16/032,263, filed on Jul. 11, 2018, now Pat. No. 10,765,294.

(60) Provisional application No. 62/530,894, filed on Jul. 11, 2017.

(51) Int. Cl.

| | |
|---|---|
| ***A47L 13/18*** | (2006.01) |
| ***A47L 25/00*** | (2006.01) |
| ***A47L 13/19*** | (2006.01) |
| ***A41D 19/00*** | (2006.01) |

(52) U.S. Cl.

CPC ..... *A47L 25/005* (2013.01); *A41D 19/00* (2013.01); *A47L 13/18* (2013.01); *A47L 13/19* (2013.01)

(58) Field of Classification Search

CPC ..... A41D 19/0006; A41D 19/0024; A41D 19/001; A47L 13/19; A47L 13/18

See application file for complete search history.

(56) References Cited

U.S. PATENT DOCUMENTS

| | | | | |
|---|---|---|---|---|
| 2,391,851 | A * | 12/1945 | Ellery | A63B 71/148 2/21 |
| 4,820,558 | A | 4/1989 | Sundberg | |
| 5,441,355 | A * | 8/1995 | Moore | A47K 7/03 401/7 |
| 5,894,623 | A | 4/1999 | Thill | |
| 5,956,770 | A * | 9/1999 | Dennis | A47L 13/18 2/160 |
| 6,275,995 | B1 * | 8/2001 | Le Gette | A47L 13/18 2/160 |
| 6,360,373 | B1 * | 3/2002 | Rehn | A41D 19/0068 2/169 |
| 7,823,244 | B2 | 11/2010 | Knopow | |
| 8,220,099 | B2 | 7/2012 | Vidmar et al. | |
| 10,765,294 | B2 * | 9/2020 | Cariello | A47L 13/19 |
| 11,324,384 | B2 * | 5/2022 | Cariello | A47L 25/005 |

(Continued)

*Primary Examiner* — Michael D Jennings

(74) *Attorney, Agent, or Firm* — Shore IP Group, PLLC; Sean R. Wilsusen, Esq.

(57) ABSTRACT

A debris capturing device includes a glove including an open end, a plurality of finger extensions including finger slots, and a thumb extension including a thumb slot. An adhesive pad is coupled to the glove. A removable pad cover is disposed on the adhesive pad. The removable pad cover is configured to expose an adhesive surface of the adhesive pad when removed. The adhesive surface faces away from the glove. The adhesive pad is dimensioned, shaped and positioned with respect to the glove to fold a distal end of the adhesive pad to contact a proximal end of the adhesive pad. The glove is dimensioned, shaped and positioned with respect to the adhesive pad to be inverted upon removal of the glove from a user's hand.

16 Claims, 8 Drawing Sheets

(56) References Cited

U.S. PATENT DOCUMENTS

| | | | | |
|---|---|---|---|---|
| 2002/0124335 | A1 | 9/2002 | Franko | |
| 2010/0218326 | A1* | 9/2010 | Yamaguchi | A47L 13/18 2/167 |
| 2011/0004974 | A1* | 1/2011 | Firouzman | A47L 13/12 2/161.8 |
| 2012/0090121 | A1* | 4/2012 | Phillips, Sr. | A63B 71/148 15/210.1 |
| 2014/0352030 | A1* | 12/2014 | Holland | A41D 19/0024 2/160 |
| 2016/0143508 | A1* | 5/2016 | Mc Grath | A47L 25/005 15/104.002 |

* cited by examiner

DEBRIS CAPTURING APPARATUS

CROSS-REFERENCE TO RELATED APPLICATION

This application is a continuation of U.S. patent application Ser. No. 17/014,497, filed Sep. 8, 2020, now U.S. Pat. No. 11,324,384, which is a continuation of U.S. patent application Ser. No. 16/032,263, filed Jul. 11, 2018, now U.S. Pat. No. 10,765,294, which claims priority to U.S. Provisional Patent Application No. 62/530,894, filed on Jul. 11, 2017, the disclosures of which are incorporated by reference herein in their entirety.

FIELD OF THE INVENTION

The present invention relates to a debris capturing apparatus. One or more exemplary embodiments of the present invention provide a debris capturing apparatus including a glove and an adhesive pad coupled to the glove.

SUMMARY

An exemplary embodiment of the present invention provides a debris capturing device including a glove including an open end, a plurality of finger extensions including finger slots, and a thumb extension including a thumb slot. An adhesive pad is coupled to the glove. A removable pad cover is disposed on the adhesive pad. The removable pad cover is configured to expose an adhesive surface of the adhesive pad when removed. The adhesive surface faces away from the glove. The adhesive pad is dimensioned, shaped and positioned with respect to the glove to fold a distal end of the adhesive pad to contact a proximal end of the adhesive pad. The glove is dimensioned, shaped and positioned with respect to the adhesive pad to be inverted upon removal of the glove from a user's hand.

According to an exemplary embodiment of the present invention, the thumb extension may be unattached to the adhesive pad.

According to an exemplary embodiment of the present invention, the glove may include polyethylene.

According to an exemplary embodiment of the present invention, the adhesive pad may include a curved proximal end and a substantially square distal end.

According to an exemplary embodiment of the present invention, the adhesive pad may be coupled to a palm side of the glove.

According to an exemplary embodiment of the present invention, the debris capturing device may include a perforated line formed in the adhesive pad and the removable pad cover along a direction perpendicular to an extending direction to the adhesive pad. The perforated line may be dimensioned, shaped and positioned to guide the folding of the adhesive pad substantially in half when the distal end of the adhesive pad is folded to contact the proximal end of the adhesive pad.

According to an exemplary embodiment of the present invention, the debris capturing device may include an extension portion extending proximally from a proximal end of the glove on a palm side of the glove.

According to an exemplary embodiment of the present invention, the adhesive pad may be coupled to the extension portion.

An exemplary embodiment of the present invention provides a debris capturing device includes a mitten including an open end, a finger pocket and a thumb extension including a thumb slot. An adhesive pad is coupled to the mitten. A removable pad cover is disposed on the adhesive pad. The removable pad cover is configured to expose an adhesive surface of the adhesive pad when removed. The adhesive surface faces away from the mitten. The adhesive pad is dimensioned, shaped and positioned with respect to the mitten to fold a distal end of the adhesive pad to contact a proximal end of the adhesive pad. The mitten is dimensioned, shaped and positioned with respect to the adhesive pad to be inverted upon removal of the mitten from a user's hand.

According to an exemplary embodiment of the present invention, the mitten may include polyethylene.

According to an exemplary embodiment of the present invention, the adhesive pad may be coupled to a palm side of the mitten.

According to an exemplary embodiment of the present invention, an extension portion may extend proximally from a proximal end of the mitten on a palm side of the mitten.

According to an exemplary embodiment of the present invention, the adhesive pad may be coupled to the extension portion.

BRIEF DESCRIPTION OF THE FIGURES

The above and other features of the present invention will become more apparent by describing in detail exemplary embodiments thereof, with reference to the accompanying drawings, in which.

DETAILED DESCRIPTION

Figure 1:
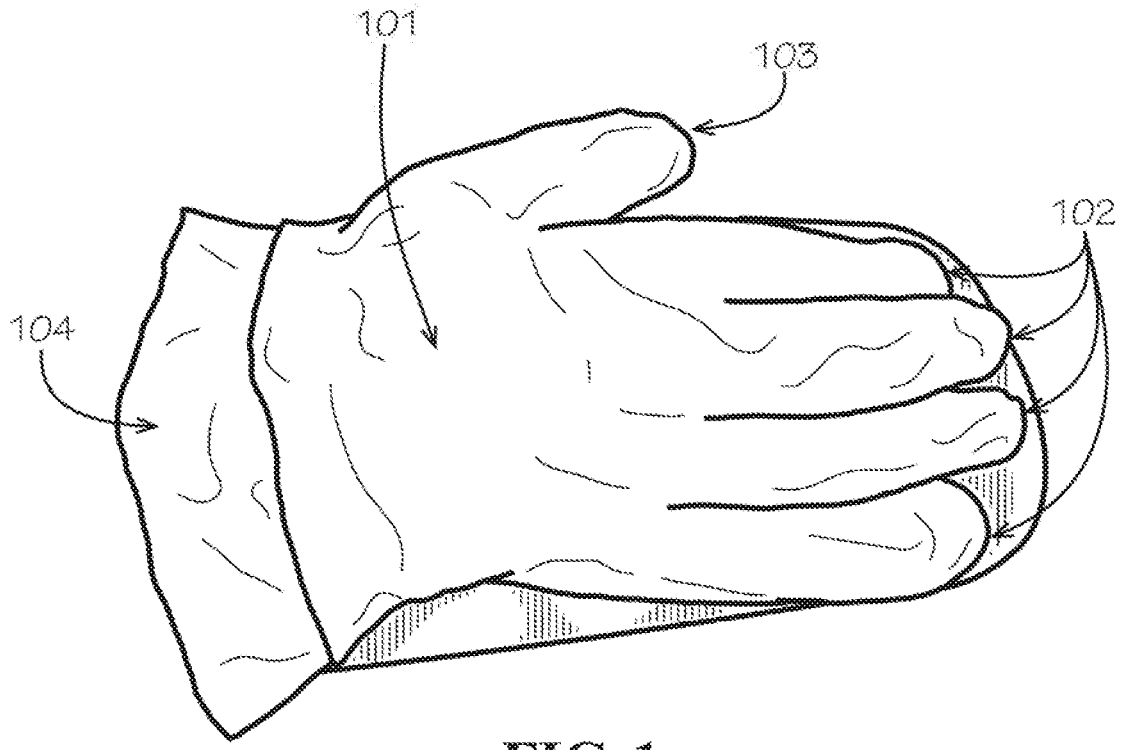
FIG. 1 illustrates a back side view of a debris capturing device according to an exemplary embodiment of the present invention.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

Exemplary embodiments of the present invention will be described more fully hereinafter with reference to the accompanying drawings. Like reference numerals may refer to like elements throughout the specification and drawings.

Figure 2:
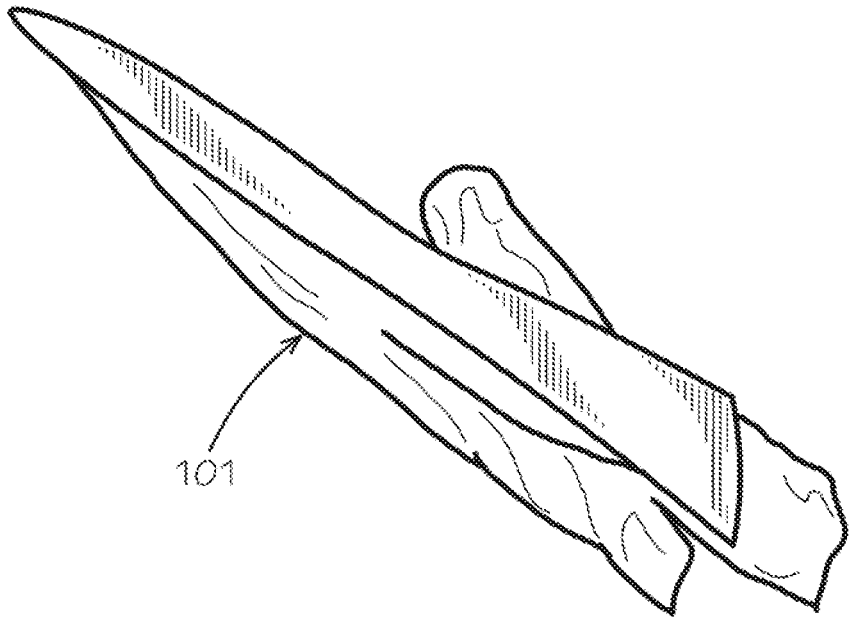
FIG. 2 illustrates a side view of a debris capturing device according to an exemplary embodiment of the present invention.
Figure 3:
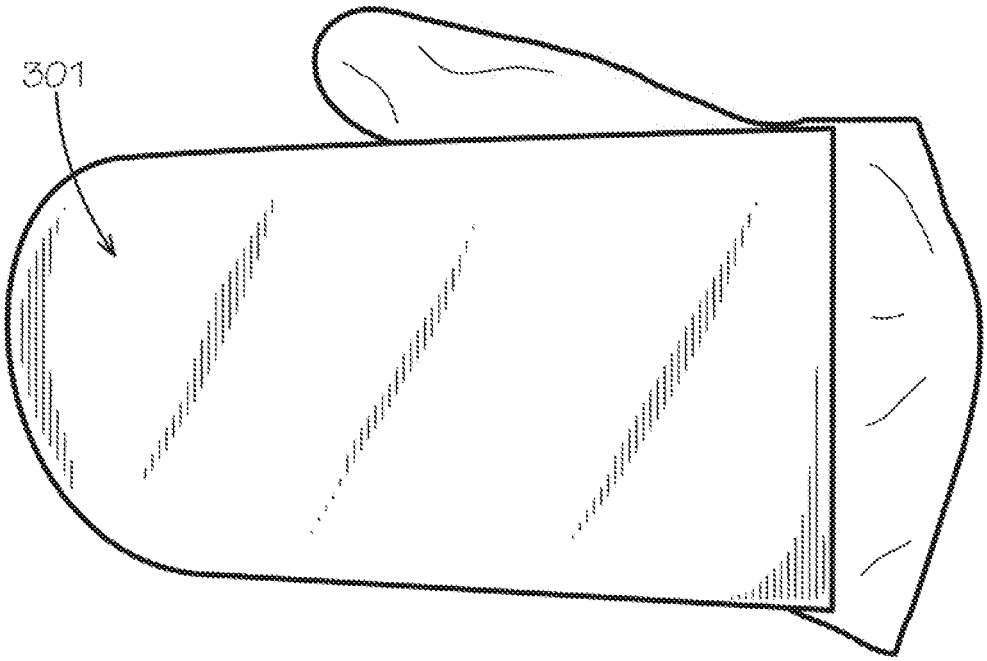
FIG. 3 illustrates a palm side view of a debris capturing device according to an exemplary embodiment of the present invention.
Figure 4:
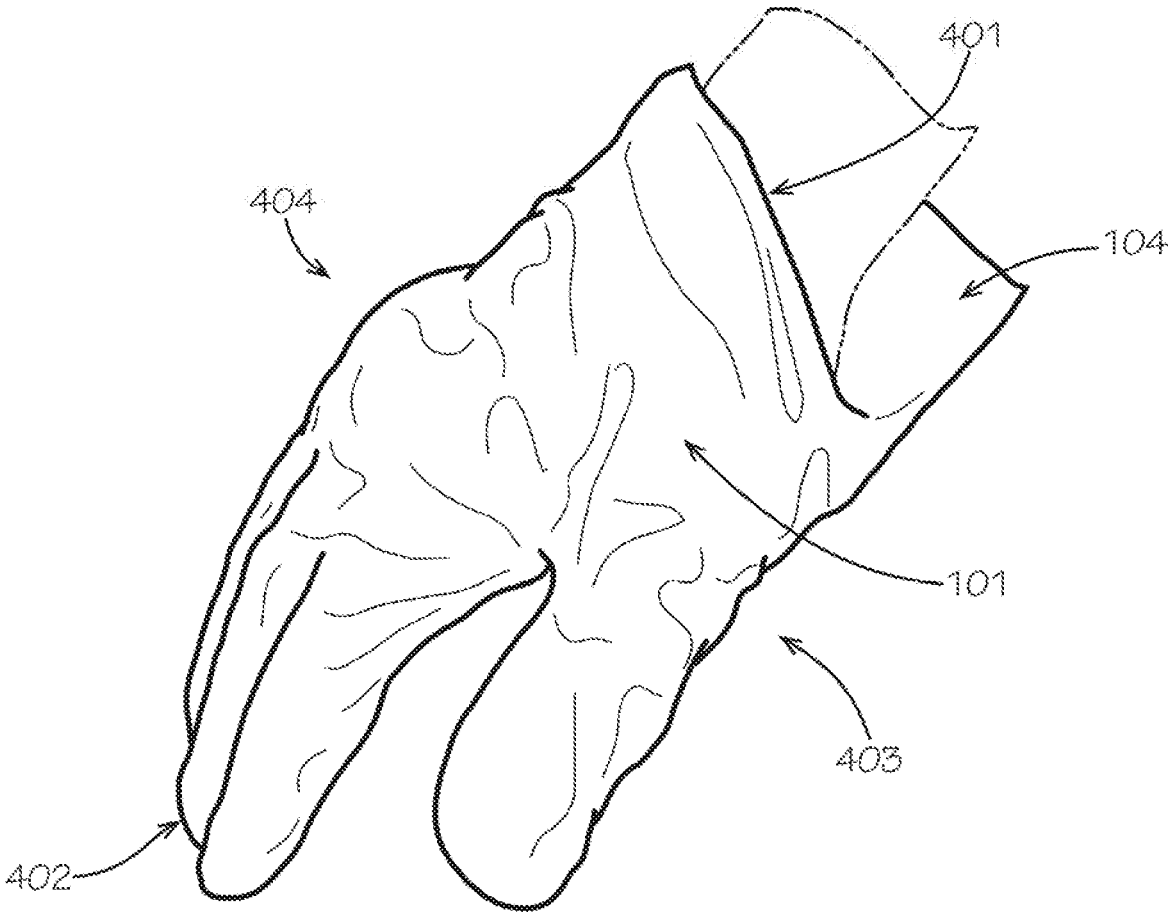
FIG. 4 illustrates an angled side view of a debris capturing device according to an exemplary embodiment of the present invention.
Figure 5:
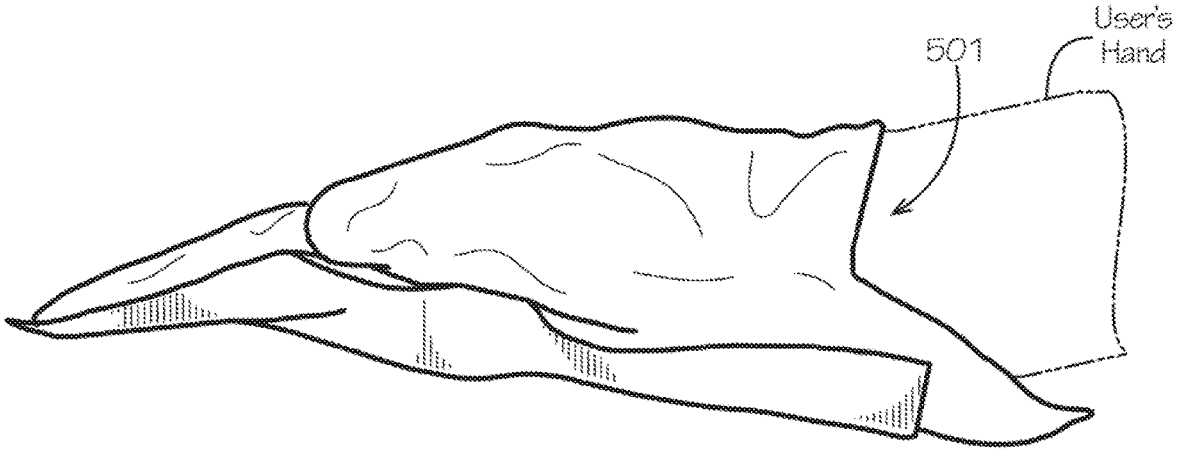
FIG. 5 illustrates a side view of a debris capturing device according to an exemplary embodiment of the present invention.
Figure 6:
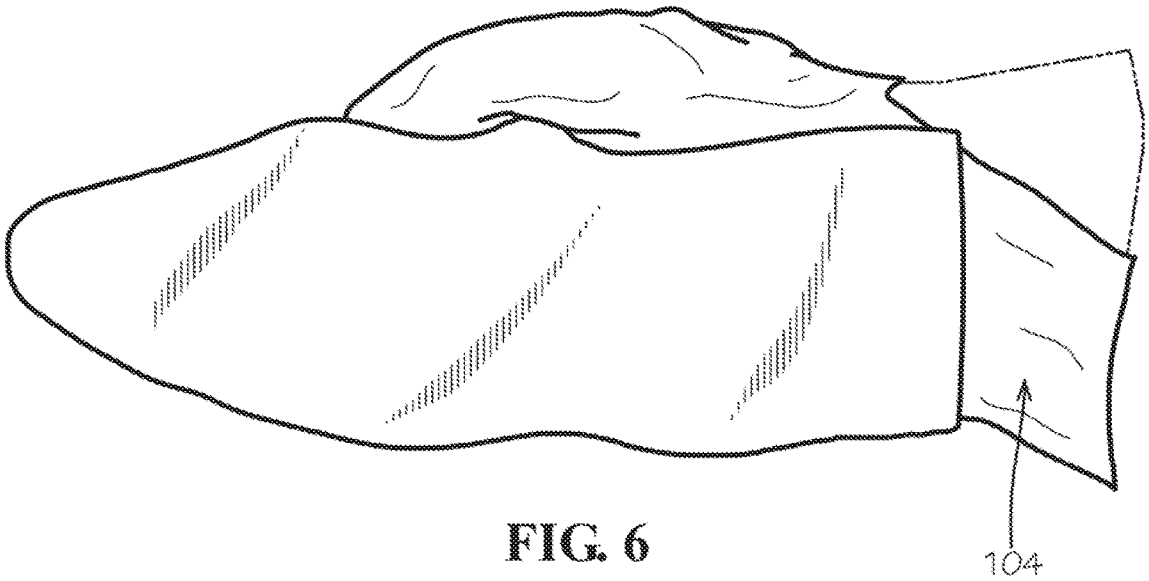
FIG. 6 illustrates an angled side view of a debris capturing device according to an exemplary embodiment of the present invention.
Figure 7:
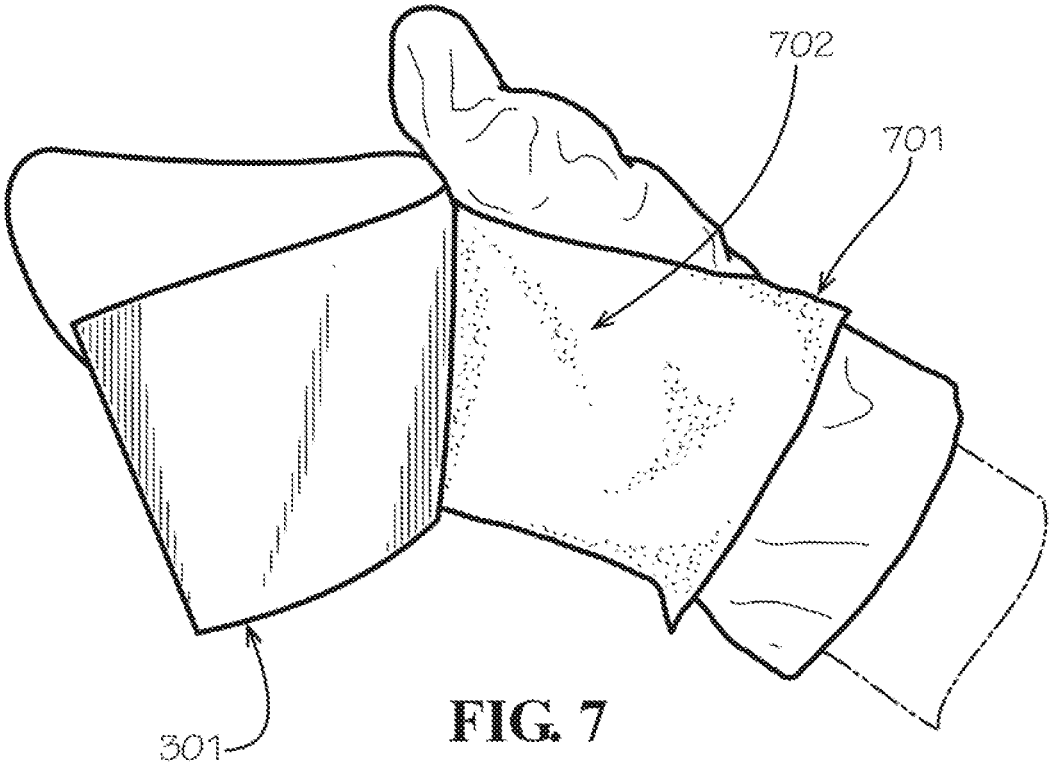
FIG. 7 illustrates a palm side view of a debris capturing device according to an exemplary embodiment of the present invention.
Figure 8:
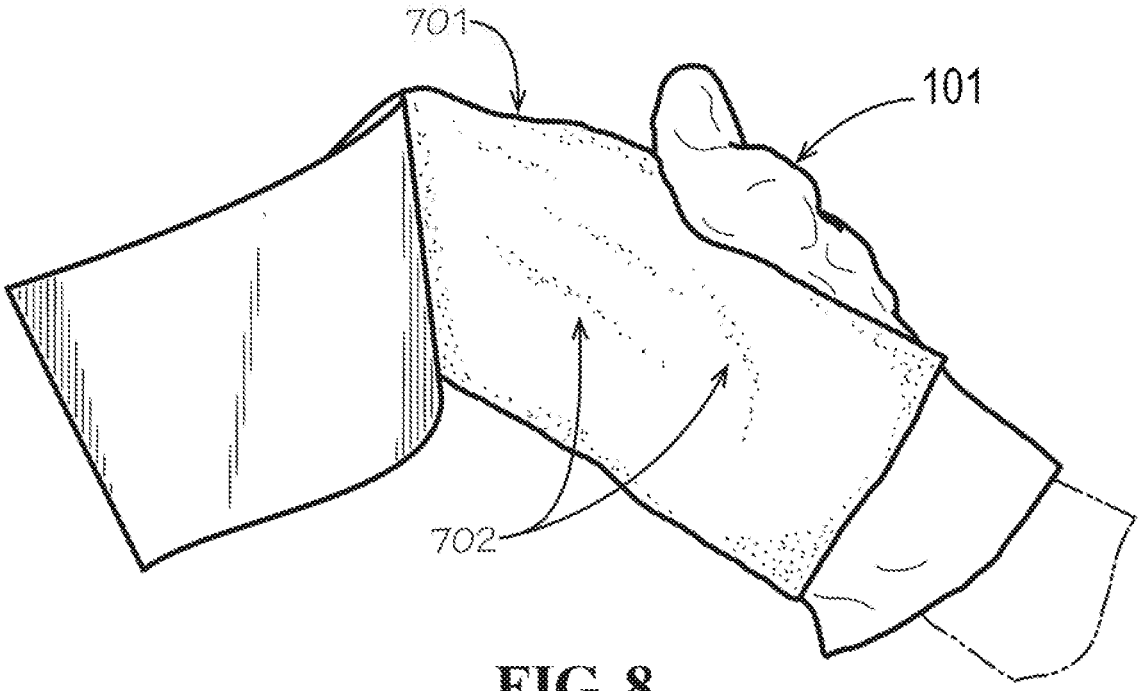
FIG. 8 illustrates a palm side view of a debris capturing device according to an exemplary embodiment of the present invention.
Figure 9:
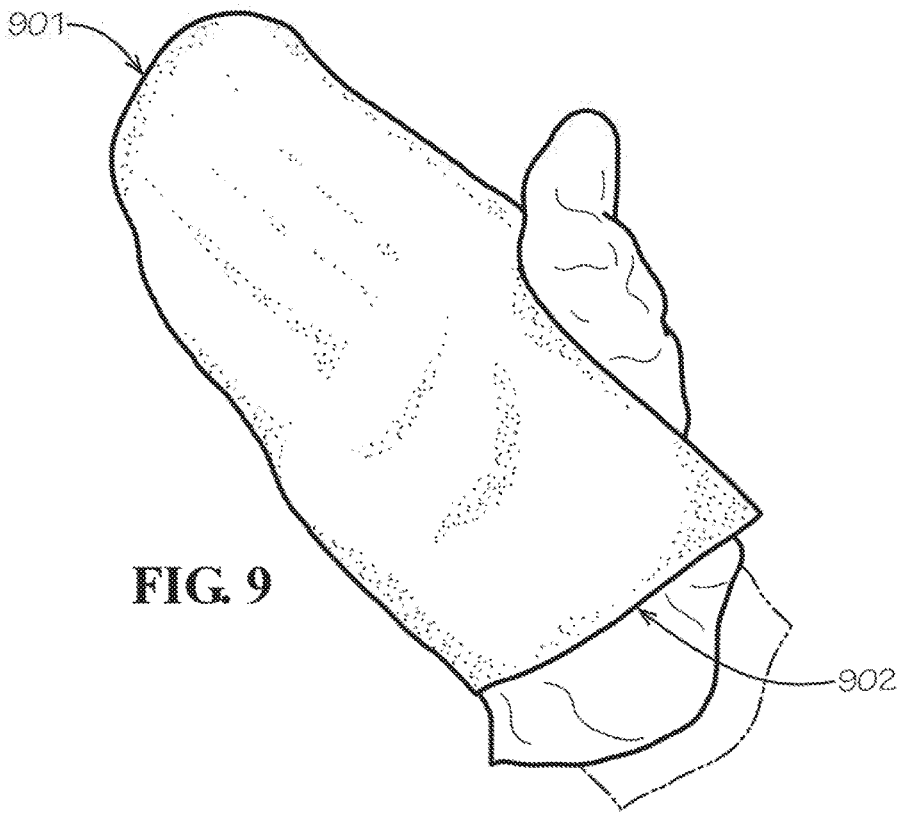
FIG. 9 illustrates a palm side view of a debris capturing device according to an exemplary embodiment of the present invention.
Figure 10:
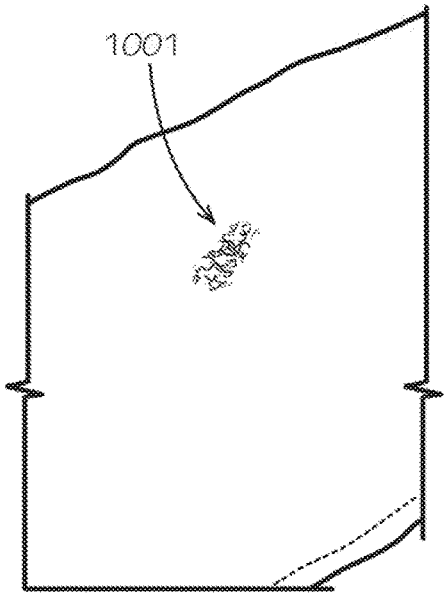
FIGS. 10-17 illustrate a process of removing an item of debris using a debris capturing device according to an exemplary embodiment of the present invention.
Figure 11:
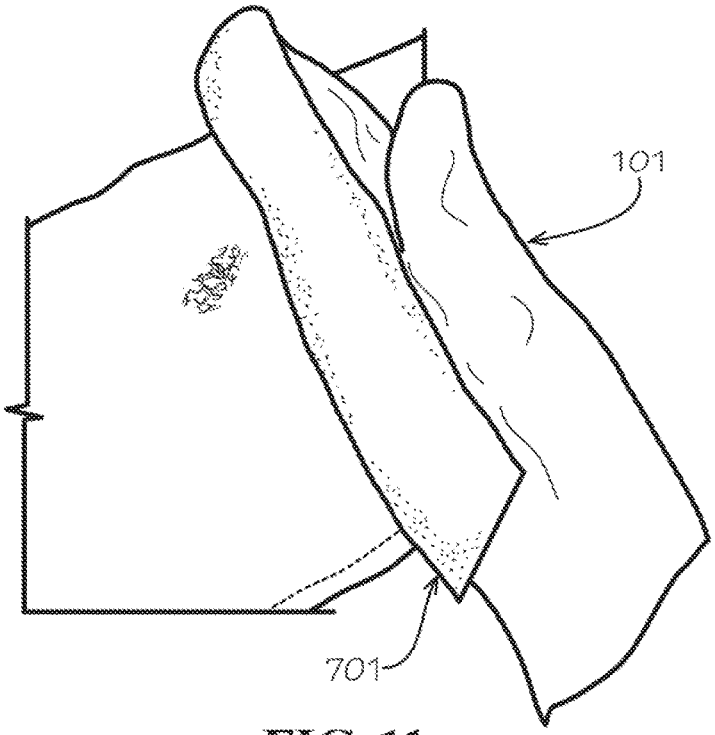
Figure 12:
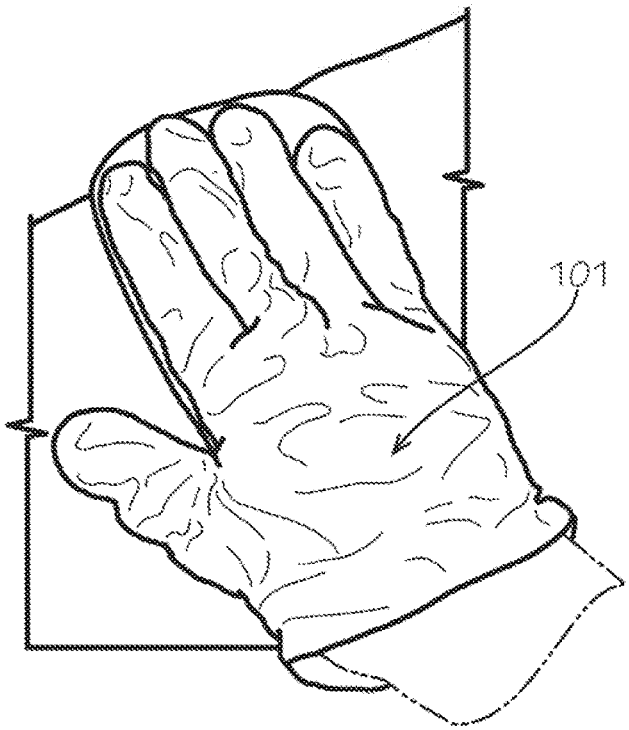
Figure 13:
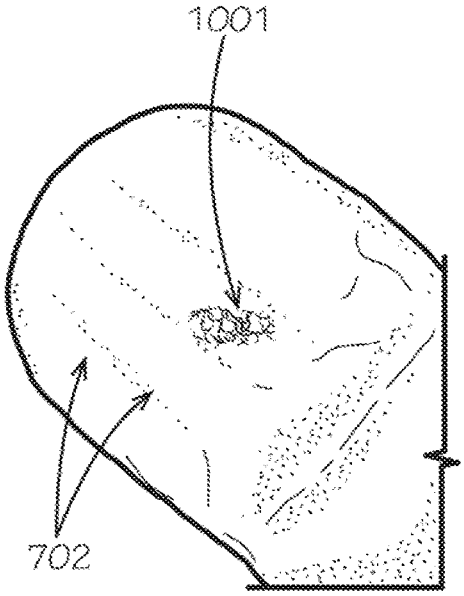
Figure 14:
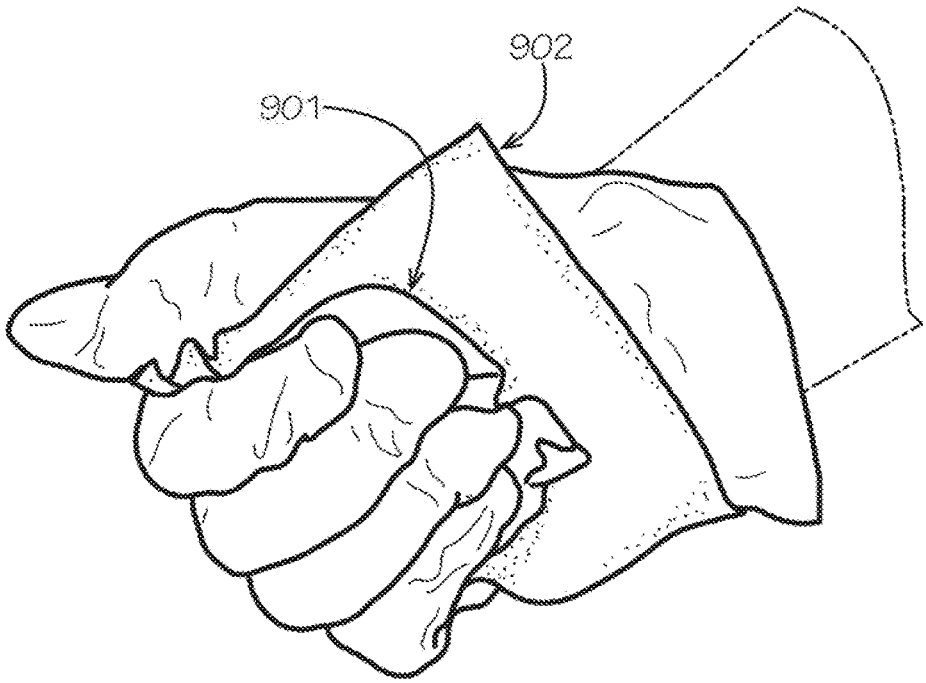
Figure 15:
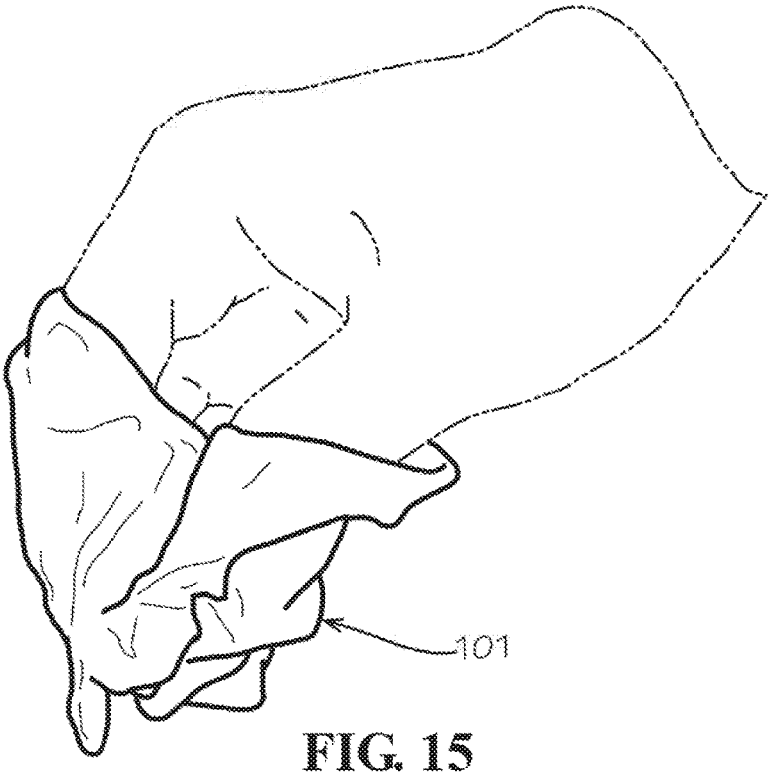
Figure 16:
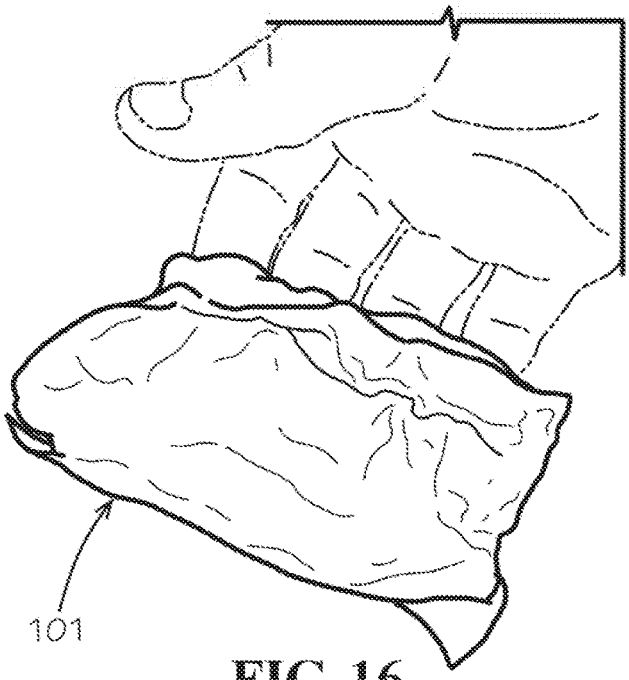
Figure 17:
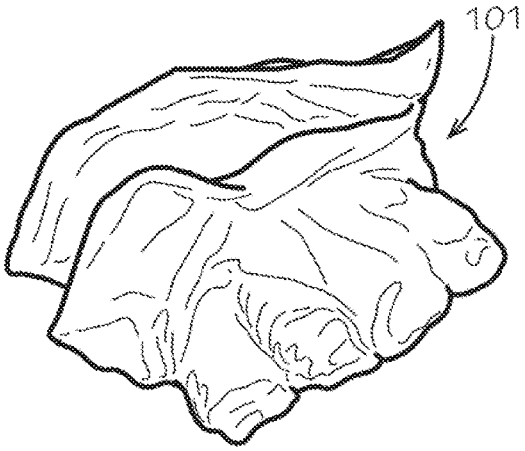
Figure 19:
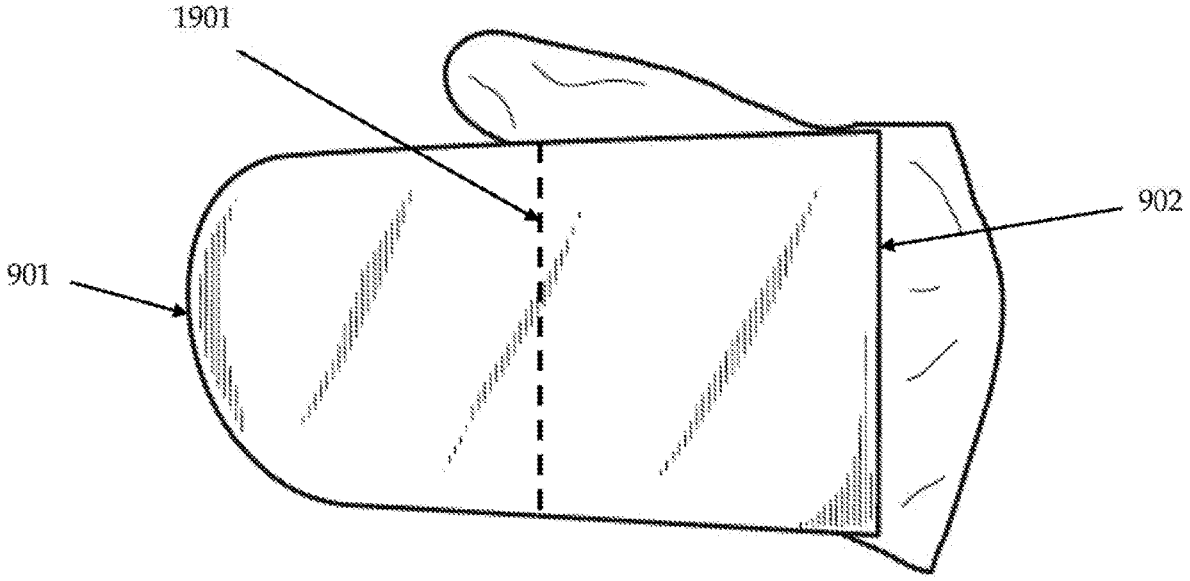
FIG. 19 illustrates a debris capturing device according to an exemplary embodiment of the present invention.

FIG. 1 illustrates a back side view of a debris capturing device according to an exemplary embodiment of the present invention. FIG. 2 illustrates a side view of a debris capturing device according to an exemplary embodiment of the present invention. FIG. 3 illustrates a palm side view of a debris capturing device according to an exemplary embodiment of the present invention. FIG. 4 illustrates an angled side view of a debris capturing device according to an exemplary embodiment of the present invention. FIG. 5 illustrates a side view of a debris capturing device according to an exemplary embodiment of the present invention. FIG. 6 illustrates an angled side view of a debris capturing device according to an exemplary embodiment of the present invention. FIG. 7 illustrates a palm side view of a debris capturing device according to an exemplary embodiment of the present invention. FIG. 8 illustrates a palm side view of a debris capturing device according to an exemplary embodiment of the present invention. FIG. 9 illustrates a palm side view of a debris capturing device according to an exemplary embodiment of the present invention. FIG. 19 illustrates a debris capturing device according to an exemplary embodiment of the present invention.

FIGS. 10-17 illustrate a process of removing an item of debris using a debris capturing device according to an exemplary embodiment of the present invention.

Referring to FIGS. 1-17 and 19, an exemplary embodiment of the present invention provides a debris capturing device including a glove 101 including an open end 501, a plurality of finger extensions 102 including finger slots, and a thumb extension 103 including a thumb slot. An adhesive pad 701 is coupled to the glove 101. A removable pad cover 301 is disposed on the adhesive pad 701. The removable pad cover 301 is configured to expose an adhesive surface 702 of the adhesive pad 701 when removed. The adhesive surface 702 faces away from the glove 101. The adhesive pad 701 is dimensioned, shaped and positioned with respect to the glove 101 to fold a distal end of the adhesive pad 901 to contact a proximal end of the adhesive pad 902. The glove 101 is dimensioned, shaped and positioned with respect to the adhesive pad 701 to be inverted upon removal of the glove 101 from a user's hand.

According to an exemplary embodiment of the present invention, the thumb extension 103 may be unattached to the adhesive pad 701. This may allow the thumb extension 103 to be utilized to assist in folding the adhesive pad 701 substantially in half and to allow the folded adhesive pad 701 to be pulled into the glove 101 when the glove 101 is inverted following capturing of debris (e.g., lint). An exemplary process of inverting the glove 101 is described in more detail below with reference to FIGS. 10-17.

According to an exemplary embodiment of the present invention, the glove 101 may include polyethylene. A polyethylene glove 101 may be relatively lighter and relatively more pliable than, for example, a latex glove. This provides the benefit of allowing the adhesive pad 701 to be folded more easily, and provides the benefit of allowing the glove 101 to be inverted after use to fold the adhesive pad 701 inside the folded glove. Additionally, the use of a polyethylene glove has the benefit of preventing an allergic reaction of a user to a latex glove. Additionally, latex gloves commonly include a powdered coating, which may be omitted in a polyethylene glove, and thus a mess caused by powder being sloughed off of a latex glove may be avoided.

According to an exemplary embodiment of the present invention, the adhesive pad 701 may include a curved proximal end and a substantially square distal end. The curved proximal end of the adhesive pad 701 provides the benefit of eliminating outward facing corners, which may contact an undesired surface when the debris capturing device according to an exemplary embodiment if moved through a relatively tight space. This may prevent the adhesive surface 702 from contacting undesired objects or surfaces. The substantially square distal end may assist the user in squarely folding the adhesive pad 701 substantially in half so the adhesive pad 701 may be easily folded inside the inverted glove after use.

According to an exemplary embodiment of the present invention, the adhesive pad 701 may be coupled to a palm side of the glove 403. Thus, the adhesive pad 701 may be relatively easily folded by the user folding the user's hand, and may be easily manipulated by the user's fingers.

According to an exemplary embodiment of the present invention, the debris capturing device may include a perforated line (see, e.g., perforated line 1901 described in more detail below with reference to FIG. 19, which may also be available to the debris capturing device described herein in more detail with reference to FIGS. 1-17) formed in the adhesive pad 701 and the removable pad cover 301 along a direction perpendicular to an extending direction to the adhesive pad 701. The perforated line may be dimensioned, shaped and positioned to guide the folding of the adhesive pad 701 substantially in half when the distal end of the adhesive pad 901 is folded to contact the proximal end of the adhesive pad 902.

According to an exemplary embodiment of the present invention, the debris capturing device may include an extension portion 104 extending proximally from a proximal end of the glove 401 on a palm side of the glove 403 opposite a back side of the glove 404. According to an exemplary embodiment of the present invention, the adhesive pad 701 may be coupled to the extension portion 104. The proximal end of the glove 401 may be positioned opposite a distal end of the glove 402.

The debris capturing device may be used to capture lint or debris 1001. The process of capturing lint or debris 1001 and inverting the glove 101 after use will be described in more detail below with reference to FIGS. 7-17.

Referring to FIGS. 7-17, the removable pad cover 301 may be removed from the adhesive pad 701 to expose the adhesive surface 702. The adhesive surface 702 of the adhesive pad 701 may be pressed against line or debris 1001 and the lint or debris 1001 may become adhered to the adhesive surface 702.

As an example, the adhesive surface 702 of the adhesive pad 701 may include a pressure sensitive adhesive (PSA). PSAs may be relatively tacky at room temperature and/or in a dry form. PSAs may adhere firmly to a variety of surfaces through the application of force. PSAs. However, exemplary embodiments of the present invention are not limited thereto, and other adhesives may be employed.

As an example, the adhesive surface 702 of the adhesive pad 701 may include an acrylic adhesive, such as an epoxy resin, a rubber based adhesive (e.g., based on butadiene-styrene, butyl, polyisobutylene or nitrile compounds), a silicon adhesive or a polyurethane adhesive. However, exemplary embodiments of the present invention are not limited thereto, and other adhesives may be employed.

After the lint or debris 1001 is adhered to the adhesive surface 702 of the adhesive pad 701, the adhesive pad 701 may be folded substantially in half. The user's thumb in the unattached thumb extension 103 may assist in keeping the adhesive pad 701 straight during folding. The adhesive pad 701 is dimensioned, shaped and positioned with respect to the glove 101 to fold the distal end of the adhesive pad 901 to contact the proximal end of the adhesive pad 902. The glove 101 is dimensioned, shaped and positioned with respect to the adhesive pad 701 to be inverted upon removal of the glove 101 from a user's hand.

After the distal end of the adhesive pad 901 is folded to contact the proximal end of the adhesive pad 902, the user may invert the glove 101 by pulling the glove off of the user's hand. The glove may be removed starting with an area of the glove 101 near the user's wrist and pulling the glove 101 toward the user's finger tips to turn the glove 101 inside out.

Thus, the adhesive pad 701 holding the captured debris or lint 1001 may be positioned inside the inverted glove 101. This may provide the benefit of sanitary storage and disposal at a later time. For example the inverted glove may be placed inside a user's pocket or bag with the debris or lint 1001 not being exposed.

According to an exemplary embodiment of the present invention, a plurality of unused debris capturing devices may be folded and disposed inside a storage pack or storage dispenser. Thus, a plurality of unused debris capturing devices may be sold as a kit. The storage pack may allow one unused debris capturing devices to be withdrawn at a time for convenient access, single use and disposal of the unused debris capturing device.

Each of the components and features described above with reference to FIGS. 1-17 are available to the debris capturing apparatus according to an exemplary embodiment of the present invention described below with reference to FIG. 18. Thus, duplicative descriptions may be omitted below.

Figure 18:
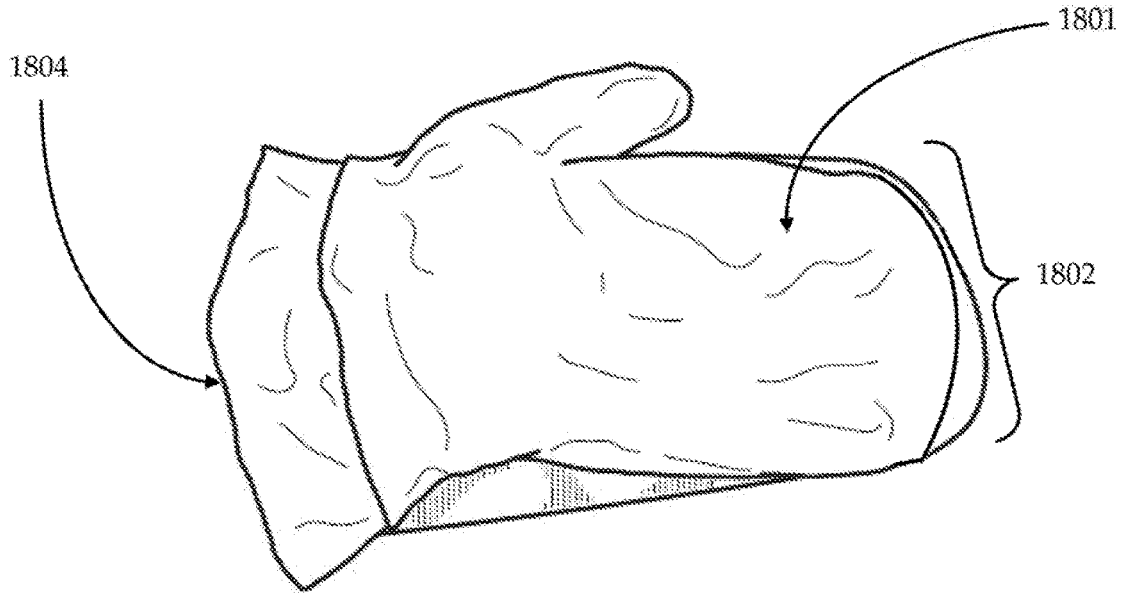
FIG. 18 illustrates a debris capturing device according to an exemplary embodiment of the present invention.

Referring to FIG. 18, an exemplary embodiment of the present invention provides a debris capturing device including a mitten 1801 including an open end, a finger pocket 1802 and a thumb extension (see, e.g., thumb extension 103 described in more detail above) including a thumb slot. An adhesive pad 701 is coupled to the mitten 1801. A removable pad cover 301 is disposed on the adhesive pad 701. The removable pad cover 301 is configured to expose an adhesive surface 702 of the adhesive pad 701 when removed. The adhesive surface 702 faces away from the mitten 1801. The adhesive pad 701 is dimensioned, shaped and positioned with respect to the mitten 1801 to fold a distal end of the adhesive pad 901 to contact a proximal end of the adhesive pad 902. The mitten 1801 is dimensioned, shaped and positioned with respect to the adhesive pad 701 to be inverted upon removal of the mitten 1801 from a user's hand.

According to an exemplary embodiment of the present invention, the mitten 1801 may include polyethylene, as described above in more detail.

According to an exemplary embodiment of the present invention, the adhesive pad 701 may be coupled to a palm side of the mitten 1801.

According to an exemplary embodiment of the present invention, an extension portion 1804 may extend proximally from a proximal end of the mitten 1801 on a palm side of the mitten 1801.

According to an exemplary embodiment of the present invention, the adhesive pad 701 may be coupled to the extension portion 1804.

According to an exemplary embodiment of the present invention, the adhesive pad 701 described herein may be substituted with a cloth pad such as an electrostatic dusting cloth coupled to the glove 403 described herein. The electrostatic dusting cloth may include a plurality of polyester fibers. The polyester fibers may be woven together. The electrostatic dusting cloth may employ static electricity to attract dust and debris to the cloth pad. Thus, dust and debris may adhere to the cloth pad without use of an adhesive. The glove 403 coupled to the cloth pad may be inverted, as described in more detail above.

The electrostatic charge in the electrostatic dusting cloth may be formed by chemically treating the electrostatic dusting cloth to form a negative charge on the electrostatic dusting cloth. Thus, dust may adhere to the electrostatic dusting cloth.

According to an exemplary embodiment of the present invention, the cloth pad may include a microfiber material configured to attract dust. The microfiber material may be a synthetic fiber finer than one denier or decitex/thread. Such a synthetic fiber may have a diameter of less than ten micrometers.

The disclosures of each of the references, patents and published patent applications disclosed herein are each incorporated by reference herein in their entireties.

In the event of a conflict between a definition herein and a definition incorporated by reference, the definition provided herein is intended.

Having described exemplary embodiments of the present invention, it is further noted that it is readily apparent to those of ordinary skill in the art that various modifications may be made without departing from the spirit and scope of the present invention.

What is claimed is:

1. A debris capturing device, comprising:

a glove comprising an open end, a plurality of finger extensions including finger slots, and a thumb extension including a thumb slot;

an adhesive pad coupled to the glove; and a removable pad cover disposed on the adhesive pad, wherein the removable pad cover is configured to expose an adhesive surface of the adhesive pad when removed, and wherein the adhesive surface faces away from the glove, wherein the adhesive pad is dimensioned, shaped and positioned with respect to the glove to fold a distal end of the adhesive pad to contact a proximal end of the adhesive pad, and wherein the glove is dimensioned, shaped and positioned with respect to the adhesive pad to be inverted upon removal of the glove from a user's hand.

2. The debris capturing device of claim 1, wherein the thumb extension is unattached to the adhesive pad.

3. The debris capturing device of claim 2, wherein the glove comprises polyethylene.

4. The debris capturing device of claim 3, wherein the adhesive pad comprises a curved proximal end and a substantially square distal end.

5. The debris capturing device of claim 1, wherein the adhesive pad is coupled to a palm side of the glove.

6. The debris capturing device of claim 1, further comprising a perforated line formed in the adhesive pad and the removable pad cover along a direction perpendicular to an extending direction to the adhesive pad, wherein the perforated line is dimensioned, shaped and positioned to guide the folding of the adhesive pad substantially in half when the distal end of the adhesive pad is folded to contact the proximal end of the adhesive pad.

7. The debris capturing device of claim 1, further comprising an extension portion extending proximally from a proximal end of the glove on a palm side of the glove.

8. The debris capturing device of claim 7, wherein the adhesive pad is coupled to the extension portion.

9. A debris capturing device, comprising:

a mitten comprising an open end, a finger pocket and a thumb extension including a thumb slot;

an adhesive pad coupled to the mitten; and a removable pad cover disposed on the adhesive pad, wherein the removable pad cover is configured to expose an adhesive surface of the adhesive pad when removed, and wherein the adhesive surface faces away from the mitten, wherein the adhesive pad is dimensioned, shaped and positioned with respect to the mitten to fold a distal end of the adhesive pad to contact a proximal end of the adhesive pad, and wherein the mitten is dimensioned, shaped and positioned with respect to the adhesive pad to be inverted upon removal of the mitten from a user's hand.

10. The debris capturing device of claim 9, wherein the thumb extension is unattached to the adhesive pad.

11. The debris capturing device of claim 10, wherein the mitten comprises polyethylene.

12. The debris capturing device of claim 11, wherein the adhesive pad comprises a curved proximal end and a substantially square distal end.

13. The debris capturing device of claim 9, wherein the adhesive pad is coupled to a palm side of the mitten.

14. The debris capturing device of claim 9, further comprising a perforated line formed in the adhesive pad and the removable pad cover along a direction perpendicular to an extending direction to the adhesive pad, wherein the perforated line is dimensioned, shaped and positioned to guide the folding of the adhesive pad substantially in half when the distal end of the adhesive pad is folded to contact the proximal end of the adhesive pad.

15. The debris capturing device of claim 9, further comprising an extension portion extending proximally from a proximal end of the mitten on a palm side of the mitten.

16. The debris capturing device of claim 15, wherein the adhesive pad is coupled to the extension portion.

* * * * *